US010036264B2

(12) United States Patent
McCaffrey et al.

(10) Patent No.: US 10,036,264 B2
(45) Date of Patent: Jul. 31, 2018

(54) VARIABLE AREA GAS TURBINE ENGINE COMPONENT HAVING MOVABLE SPAR AND SHELL

(71) Applicant: UNITED TECHNOLOGIES CORPORATION, Farmington, CT (US)

(72) Inventors: Michael G. McCaffrey, Windsor, CT (US); Tracy A. Propheter-Hinckley, Manchester, CT (US); Raymond Surace, Newington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 309 days.

(21) Appl. No.: 14/896,738

(22) PCT Filed: Jun. 6, 2014

(86) PCT No.: PCT/US2014/041237
§ 371 (c)(1),
(2) Date: Dec. 8, 2015

(87) PCT Pub. No.: WO2014/200831
PCT Pub. Date: Dec. 18, 2014

(65) Prior Publication Data

US 2016/0123165 A1 May 5, 2016

Related U.S. Application Data

(60) Provisional application No. 61/835,009, filed on Jun. 14, 2013.

(51) Int. Cl.
*F01D 5/14* (2006.01)
*F01D 9/02* (2006.01)
(Continued)

(52) U.S. Cl.
CPC ..... *F01D 9/02* (2013.01); *F01D 5/18* (2013.01); *F01D 17/162* (2013.01);
(Continued)

(58) Field of Classification Search
CPC . F01D 5/148; F01D 5/18; F01D 5/147; F01D 5/188; F01D 5/189; F01D 5/282;
(Continued)

(56) References Cited

U.S. PATENT DOCUMENTS 3,237,918 A 3/1966 Le Bell et al.
3,558,237 A 1/1971 Wall, Jr.
(Continued)

FOREIGN PATENT DOCUMENTS

| | | |
|---|---|---|
| EP | 1388642 | 2/2004 |
| EP | 2204537 | 7/2010 |
| WO | 9913201 | 3/1999 |

OTHER PUBLICATIONS

The Extended European Search Report for EP Application No. 14810799.8, dated Mar. 23, 2017.
(Continued)

*Primary Examiner* — Igor Kershteyn
(74) *Attorney, Agent, or Firm* — Carlson, Gaskey & Olds, P.C.

(57) ABSTRACT

A component according to an exemplary aspect of the present disclosure includes, among other things, a shell defining an interior, a spar extending into the interior and a first flange attached to the spar. The spar is configured to pivot to change a positioning of the shell.

20 Claims, 10 Drawing Sheets

(51) Int. Cl.

| | |
|---|---|
| ***F01D 17/16*** | (2006.01) |
| ***F04D 29/38*** | (2006.01) |
| ***F02C 7/20*** | (2006.01) |
| ***F01D 5/30*** | (2006.01) |
| ***F01D 5/18*** | (2006.01) |

(52) U.S. Cl.
CPC .... *F05D 2230/60* (2013.01); *F05D 2260/201* (2013.01); *F05D 2300/20* (2013.01)

(58) Field of Classification Search
CPC ..... F01D 9/041; F01D 9/02; F01D 17/162; F01D 17/165; F05D 2230/60; F05D 2300/20; F05D 2260/201
See application file for complete search history.

(56) References Cited

U.S. PATENT DOCUMENTS

| | | | | |
|---|---|---|---|---|
| 3,790,298 | A | 2/1974 | Hendrickson et al. | |
| 4,163,629 | A | 8/1979 | McDonough et al. | |
| 4,883,404 | A | 11/1989 | Sherman | |
| 5,616,001 | A | 4/1997 | Boyd | |
| 5,630,700 | A | 5/1997 | Olsen et al. | |
| 5,941,537 | A | 8/1999 | Wallace et al. | |
| 6,000,906 | A * | 12/1999 | Draskovich | F01D 5/3084 415/189 |
| 6,514,046 | B1 * | 2/2003 | Morrison | F01D 5/187 416/229 A |
| 6,709,230 | B2 * | 3/2004 | Morrison | F01D 5/189 415/115 |
| 7,452,182 | B2 | 11/2008 | Vance et al. | |
| 7,632,064 | B2 | 12/2009 | Somanath et al. | |
| 8,015,705 | B2 | 9/2011 | Wilson, Jr. et al. | |
| 8,262,345 | B2 * | 9/2012 | Andrew | F01D 5/187 415/159 |
| 2004/0096321 | A1 * | 5/2004 | Ciacci | F01D 5/186 415/209.3 |
| 2004/0253096 | A1 * | 12/2004 | Legg | F01D 9/04 415/191 |
| 2005/0076504 | A1 * | 4/2005 | Morrison et al. | F01D 5/282 29/889.72 |
| 2008/0056888 | A1 | 3/2008 | Somanath et al. | |
| 2008/0056904 | A1 | 3/2008 | Somanath et al. | |
| 2008/0279679 | A1 | 11/2008 | Morrison | |
| 2009/0003993 | A1 | 1/2009 | Prill et al. | |
| 2009/0097966 | A1 | 4/2009 | McCaffrey | |
| 2010/0162717 | A1 | 7/2010 | O'Leary | |
| 2010/0247293 | A1 | 9/2010 | McCaffrey et al. | |

OTHER PUBLICATIONS

International Search Report and Written Opinion of the International Searching Authority for international application No. PCT/US2014/041237 dated Nov. 24, 2014.

The Extended European Search Report for EP Application No. 14810799.8, dated Dec. 19, 2016.

* cited by examiner

VARIABLE AREA GAS TURBINE ENGINE COMPONENT HAVING MOVABLE SPAR AND SHELL

This invention was made with government support under Contract No. N00014-09-D-0821, awarded by the United States Navy. The government has certain rights in this invention.

BACKGROUND

This disclosure relates to a gas turbine engine, and more particularly to a variable area gas turbine engine component having a spar pivotable to change a rotational positioning of a shell.

Gas turbine engines typically include at least a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor and turbine sections typically include alternating rows of rotating blades and stationary vanes. The rotating blades impart or extract energy from the airflow that is communicated through the gas turbine engine, and the vanes direct the airflow to a downstream row of blades. The vanes can be manufactured to a fixed flow area that is optimized for a single flight point. It is also possible to alter the flow area between two adjacent vanes by providing a variable vane that rotates about a given axis to vary the flow area.

SUMMARY

A component according to an exemplary aspect of the present disclosure includes, among other things, a shell defining an interior, a spar extending into the interior and a first flange attached to the spar. The spar is configured to pivot to change a positioning of the shell.

In a further non-limiting embodiment of the foregoing component, the spar is comprised of a first material and the shell is comprised of a second material that is different from the first material.

In a further non-limiting embodiment of either of the foregoing components, the first material is a metal and the second material is a ceramic matrix composite.

In a further non-limiting embodiment of any of the foregoing components, a shaft extends from the first flange in a direction opposite from the spar.

In a further non-limiting embodiment of any of the foregoing components, the shell is an airfoil sheath.

In a further non-limiting embodiment of any of the foregoing components, the first flange extends outside of the shell.

In a further non-limiting embodiment of any of the foregoing components, the first flange is received within a pocket formed in a first platform.

In a further non-limiting embodiment of any of the foregoing components, a second platform is located on an opposite side of the shell from the first platform.

In a further non-limiting embodiment of any of the foregoing components, the spar includes a plurality of cooling openings.

In a further non-limiting embodiment of any of the foregoing components, the spar is moveable within the interior.

In a further non-limiting embodiment of any of the foregoing components, the spar is connected to a second flange opposite from the first flange.

In a further non-limiting embodiment of any of the foregoing components, a plurality of stand-offs extend between the spar and the shell.

In a further non-limiting embodiment of any of the foregoing components, the plurality of stand-offs protrude from one of the spar and the shell and extend toward the other of the spar and the shell.

A vane assembly according to an exemplary aspect of the present disclosure including, among other things, a first platform, a second platform and a variable vane that that extends between the first platform and the second platform. The variable vane includes an airfoil sheath comprised of a first material and a spar extending inside of the airfoil sheath and comprised of a second material.

In a further non-limiting embodiment of the foregoing assembly, the first material is different from the second material.

In a further non-limiting embodiment of either the foregoing assemblies, the variable vane is part of a turbine vane assembly.

A method according to another exemplary aspect of the present disclosure includes, among other things, inserting a spar inside of a shell of a component, communicating a gas load across the shell and pushing the shell onto the spar in response to the step of communicating the gas load.

In a further non-limiting embodiment of the foregoing method, the method includes pivoting the spar and changing a positioning of the shell in response to the step of pivoting.

In a further non-limiting embodiment of either of the foregoing methods, the step of inserting includes positioning the spar so that it is freely movable relative to the shell.

In a further non-limiting embodiment of any of the foregoing methods, the method includes communicating structural loads through the spar and isolating the shell from the structural loads.

The various features and advantages of this disclosure will become apparent to those skilled in the art from the following detailed description. The drawings that accompany the detailed description can be briefly described as follows.

DETAILED DESCRIPTION

This disclosure is directed to a variable area gas turbine engine component that includes a spar that is pivotable to change a rotational positioning of a shell or airfoil sheath of the component. The spar may include a ductile substrate that is capable of absorbing structural loads directed through the variable area component, and the shell is a structure that is capable of withstanding relatively extreme temperature environments. These and other features are described in detail herein.

Figure 1:
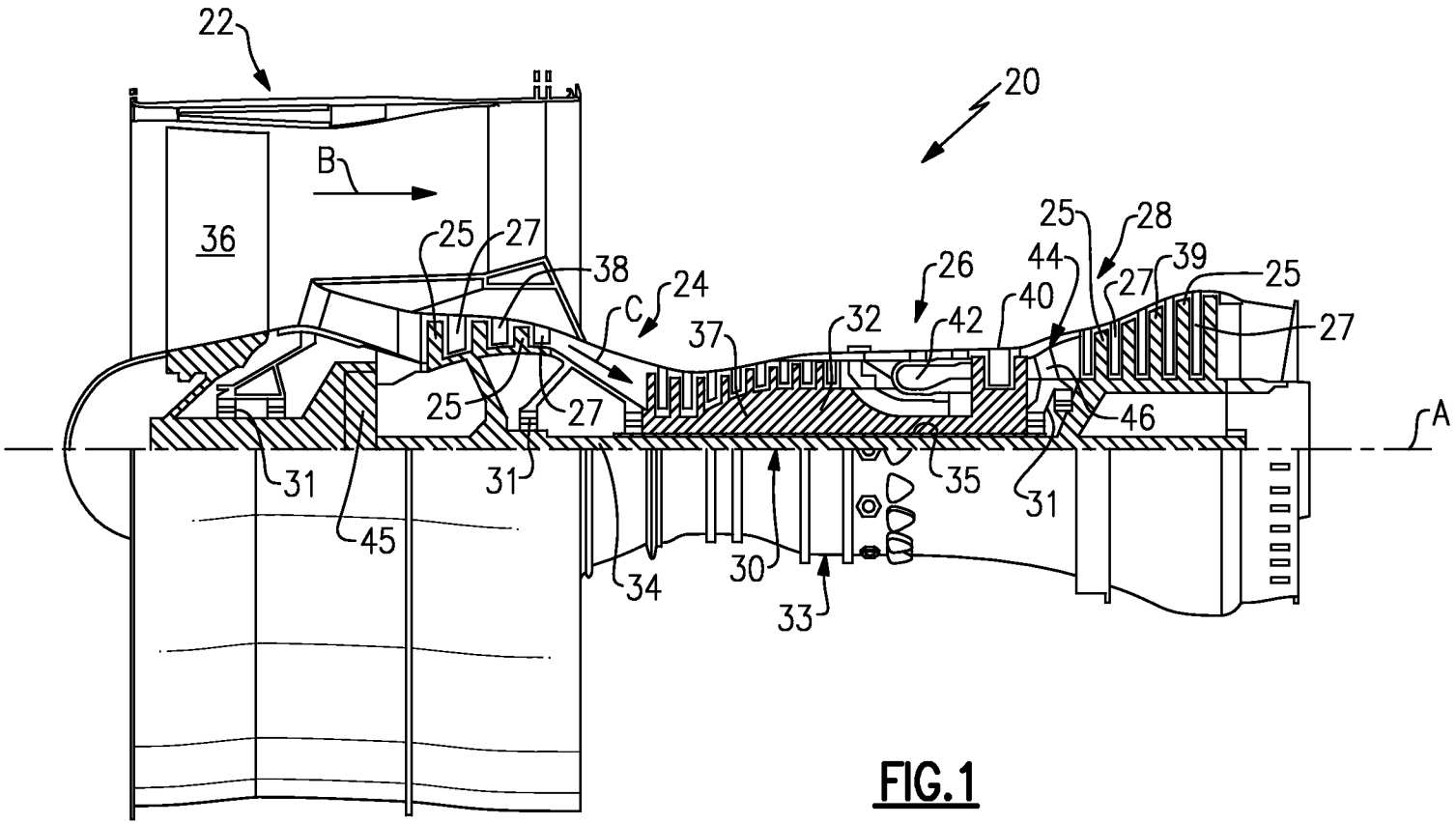
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along one or more bypass flow paths B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 impart or extract energy (in the form of pressure) from the core airflow that is communicated through the gas turbine engine 20 along the core flow path C. The vanes 27 direct the core airflow to the blades 25 to either impart or extract energy.

Figure 2:
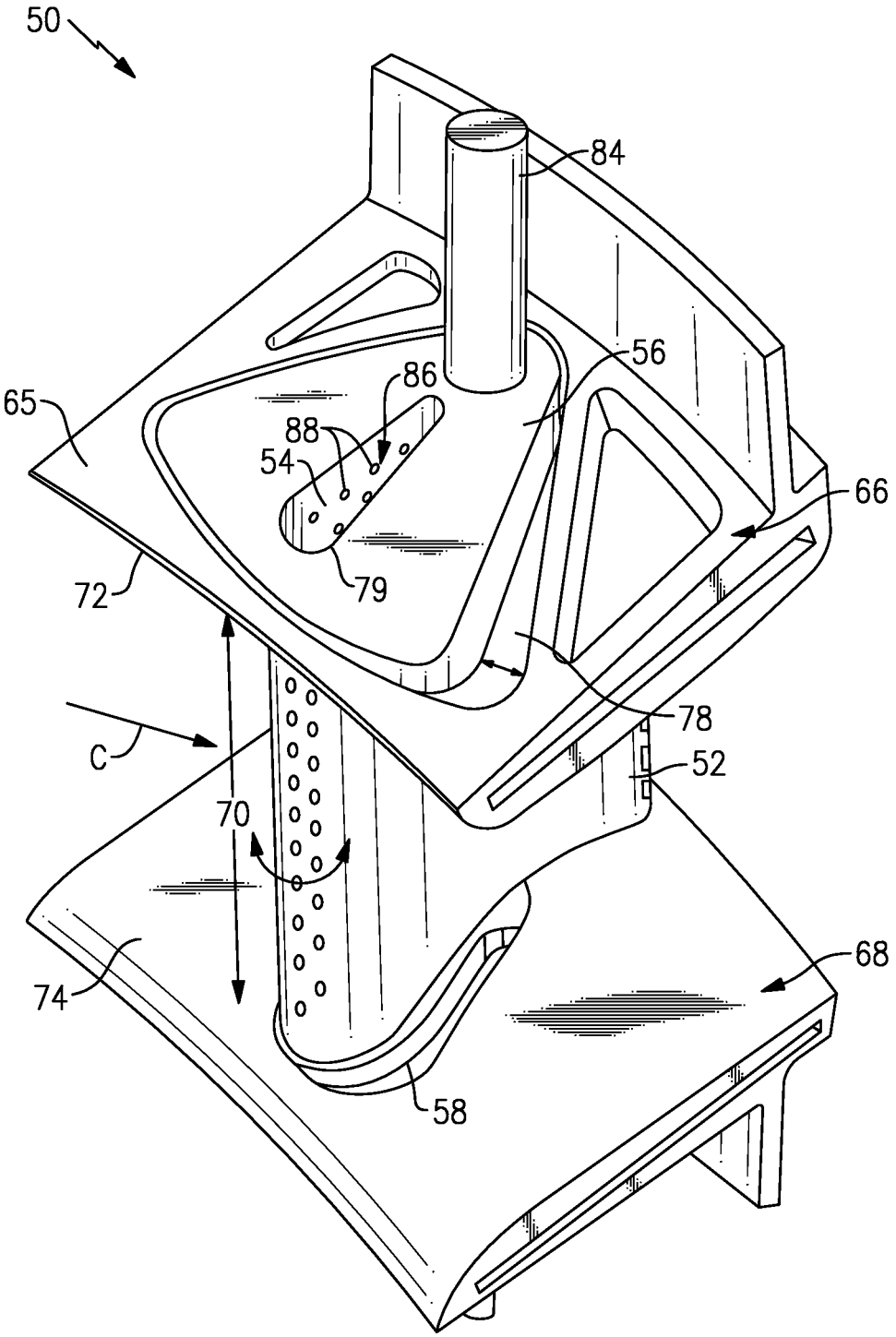
FIG. 2 illustrates a variable area component of a gas turbine engine.
Figure 3:
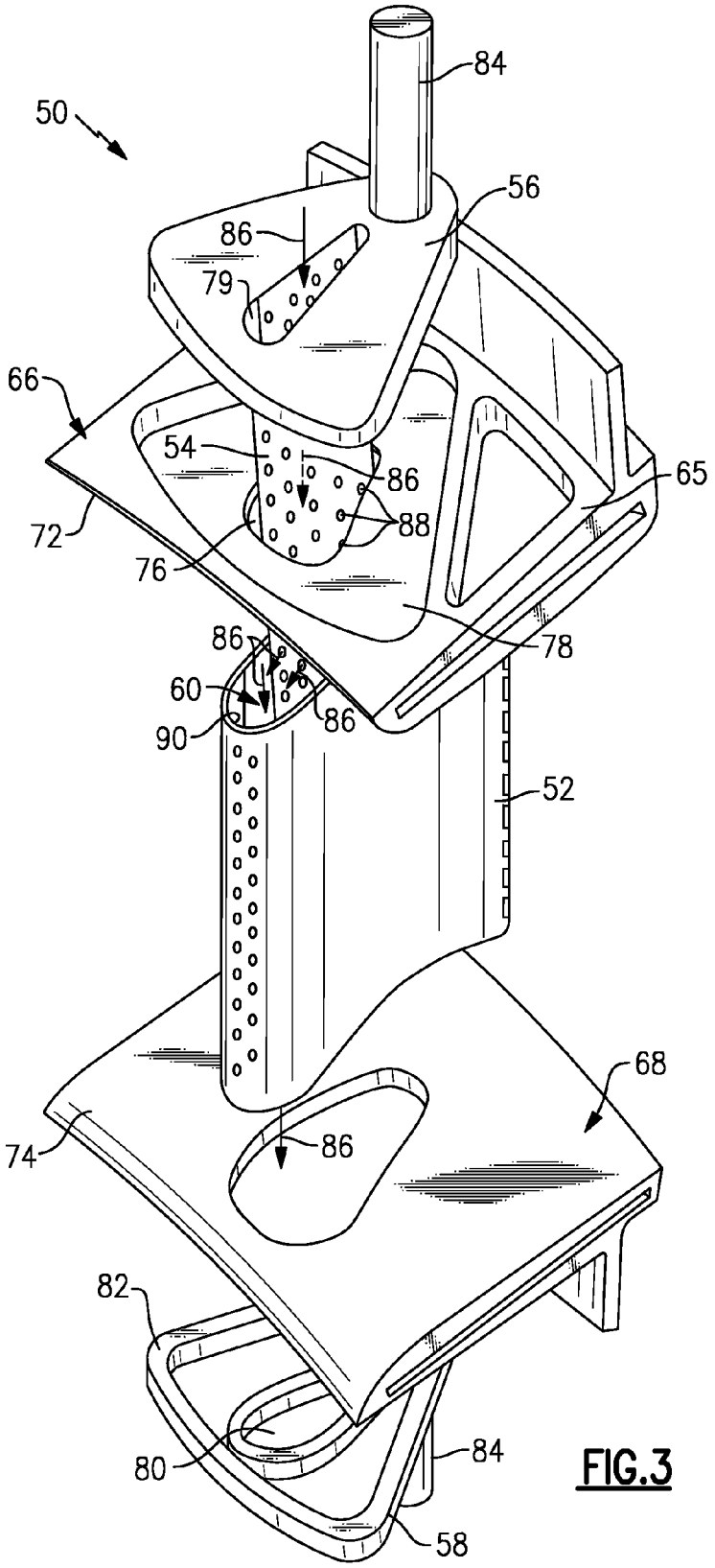
FIG. 3 illustrates an exploded view of FIG. 2.
Figure 4:
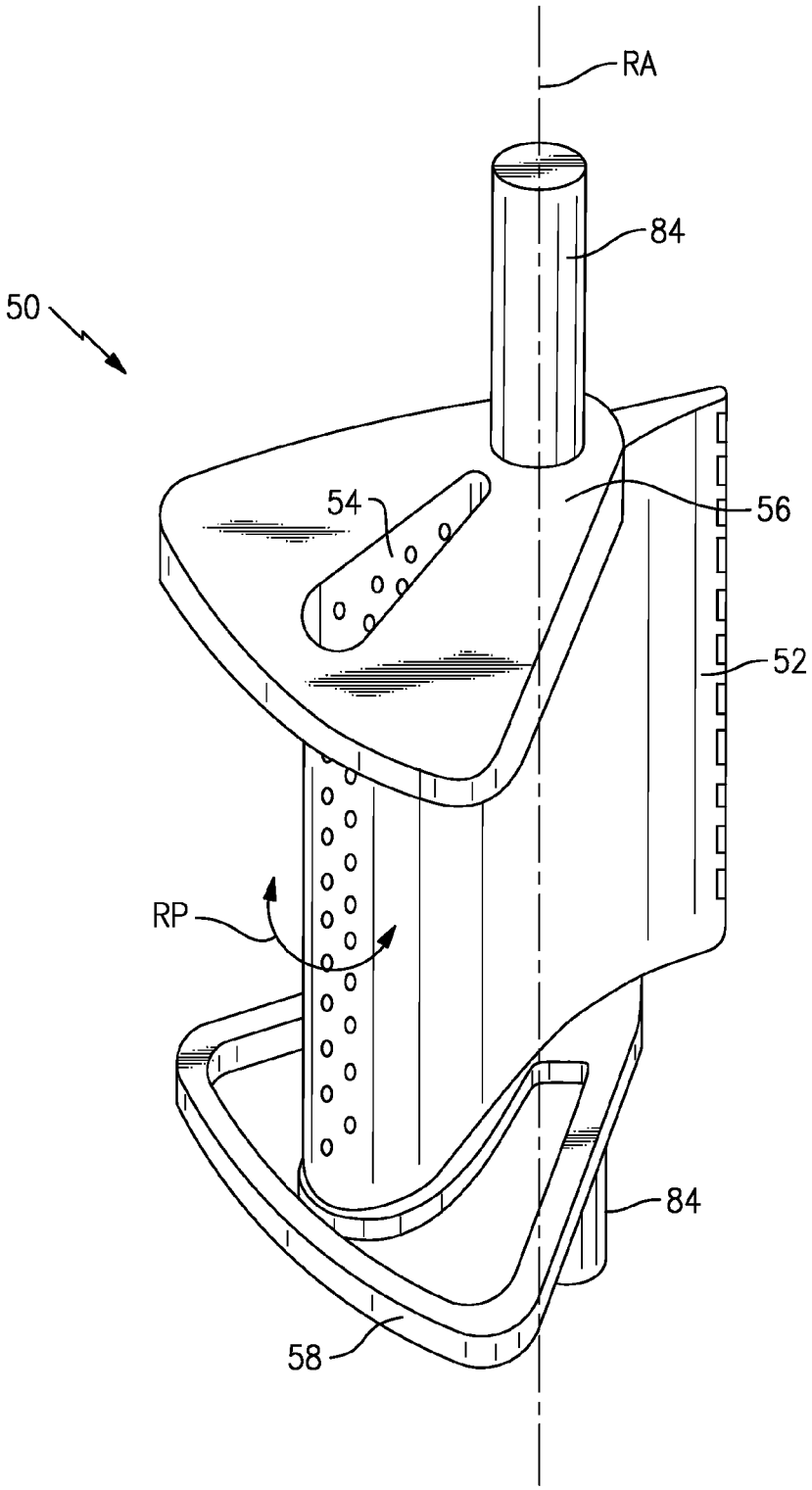
FIG. 4 illustrates portions of the component of FIG. 2.

FIGS. 2, 3 and 4 illustrate a component 50 that can be incorporated into a gas turbine engine, such as the gas turbine engine 20 of FIG. 1. The component 50 may be a variable vane of either the compressor section 24 or the turbine section 28 of the gas turbine engine 20. However, the component 50 could be employed in other sections of the gas turbine engine 20. For example, the component 50 may be a segment of any vane or nozzle assembly of the gas turbine engine 20 in which it is desirable to turn and/or direct a hot gas stream toward a downstream location.

The component 50 can be mechanically attached or otherwise linked to other segments and annularly disposed about the engine centerline longitudinal axis A (see FIG. 1) to form a full ring vane or nozzle assembly. The full ring vane or nozzle assembly may include fixed vanes (i.e., static airfoils), variable vanes that rotate to alter a flow area associated with the vane or nozzle assembly (such as similar to the component 50 shown and described herein), or both.

The exemplary component 50 may include a first platform 66, a second platform 68 and a shell 52 that extends between the first platform 66 and the second platform 68. The first platform 66 is positioned on an outer diameter side of the component 50 and the second platform 68 is positioned on an inner diameter side of the component 50 to establish outer and inner gas flow paths 72, 74 for communicating hot combustion gases along the core flow path C.

The shell 52 extends in span across an annulus 70 (see FIG. 2) between the first platform 66 and the second platform 68 and is movable relative thereto. In one embodiment, the shell 52 is an airfoil sheath. The shell 52 is not necessarily limited to the configuration illustrated by FIGS. 2, 3 and 4. For example, although a single shell 52 is illustrated, the component 50 could include additional shells or airfoil sheaths.

The exemplary component 50 may additionally include a spar 54 that is connected to a first flange 56 and, optionally, a second flange 58. The spar 54 is connectedly received by the first flange 56 and the second flange 58 at its opposite ends.

In one embodiment, the shell 52 is a hollow component that defines an interior 60 (see FIG. 3) which can receive a portion or the entirety of the spar 54. The spar 54 may be inserted through the interior 60, for example. As discussed in greater detail below, the spar 54 is pivotable in order to change a rotational positioning of the shell 52. Changing the rotational positioning of the shell 52 alters the flow area between adjacent vane segments of a vane or nozzle assembly. Adjusting the flow area in this manner may increase the efficiency of the gas turbine engine 20.

The first platform 66 may include a hole 76 (see FIG. 3) for inserting the spar 54 into the interior 60 of the shell 52. The first flange 56 is received within a pocket 78 formed in a non-gas path surface 65 of the first platform 66. In one embodiment, the pocket 78 and the first flange 56 embody a triangular shape, although other shapes are also contemplated. The first flange 56 substantially covers the hole 76 of the first platform 66 when received within the pocket 78.

If necessary, the second flange 58 is received relative to the second platform 68 and includes a pocket 80 (see FIG. 3) that may receive a portion of the spar 54. The second flange 58 may also include a sealing surface 82 for sealing relative to the second platform 68. In one embodiment, the second flange 58 is positioned relative to the second platform 68 after the spar 54 is inserted through the shell 52.

Each of the first flange 56 and the second flange 58 may include a shaft 84 that protrudes from the first flange 56 and/or the second flange 58 in a direction away from the spar 54. The flanges 56, 58 and the spar 54 may be pivoted about the shafts 84 in order to change a rotational positioning of the shell 52. In other words, a pivot point of the flanges 56, 58 and the spar 54 extends through the shafts 84.

The spar 54 and flanges 56, 58 may be rotated about the shafts 84 in any known manner, including but not limited to, direct rotary actuation, a bell crank arm, a unison ring or a ring gear system. One non-limiting example of a ring gear system that could be utilized is illustrated in U.S. Pat. No. 8,240,983, the disclosure of which is incorporated herein by reference.

A cooling fluid 86 may be directed through the spar 54 as necessary to cool the component 50. In one embodiment, the spar 54 is hollow and includes a plurality of cooling openings 88. The cooling fluid 86 may be communicated through an opening 79 in the first flange 56, then through the hollow portion of the spar 54, before purging through the cooling openings 88 to cool the inner walls 90 of the shell 52 (see FIGS. 2, 3 and 6).

In one embodiment, the shell 52 of the component 50 is made of a first material and the spar 54 is made of a second material. The first material and the second material may be different materials. For example, in one embodiment, the shell 52 is made of a ceramic matrix composite (CMC) and the spar 54 is made of a metallic material, such as a nickel alloy, molybdenum, or some other high temperature alloy. Other materials are also contemplated as within the scope of this disclosure, including other ceramic and metallic materials.

As can be appreciated, by separating the component 50 into distinct parts, structural loads acting upon the component 50 may be directed through the spar 54, while the shell 52 can simultaneously withstand relatively high temperature environments by virtue of its material makeup. In other words, the shell 52 is isolated from structural loads that may act on the component 50 by the spar 54, and the spar 54 is isolated from the relatively hot gases communicated across the component 50 by the shell 52.

FIG. 4 illustrates the component 50 with the first platform 66 and the second platform 68 removed for clarity. A rotational axis RA extends through the shafts 84 of the first flange 56 and the second flange 58. The first flange 56 and the second flange 58 may be rotated about the rotational axis RA to move the spar 54, and as a consequence of this movement, change a rotational positioning RP of the shell 52.

Figure 5A:
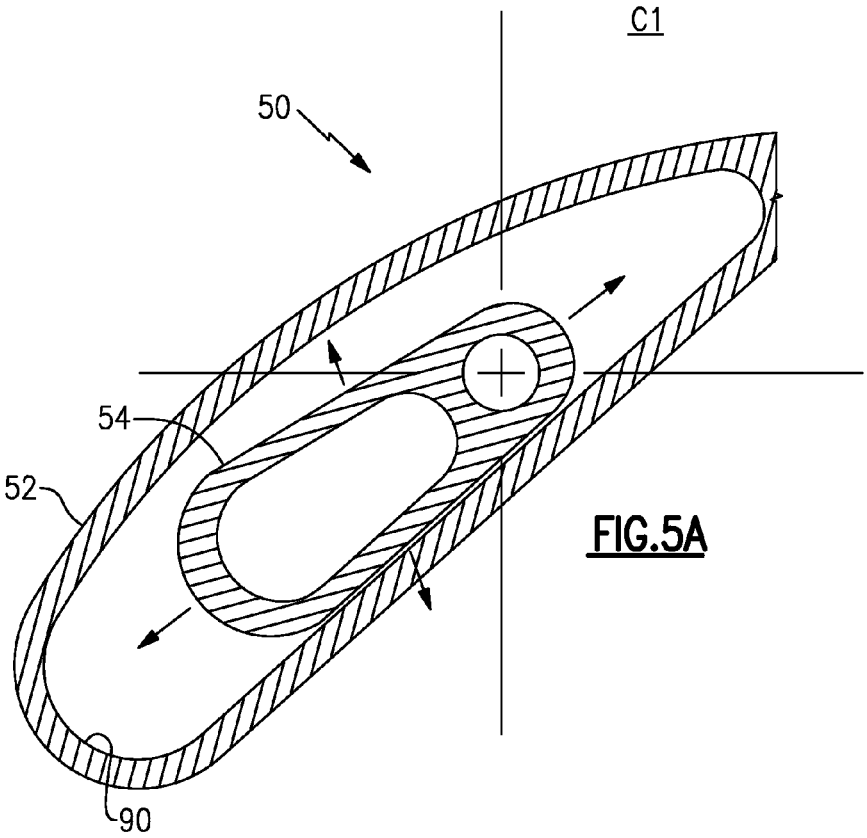
FIGS. 5A and 5B illustrate cross-sectional views of a variable area component.
Figure 5B:
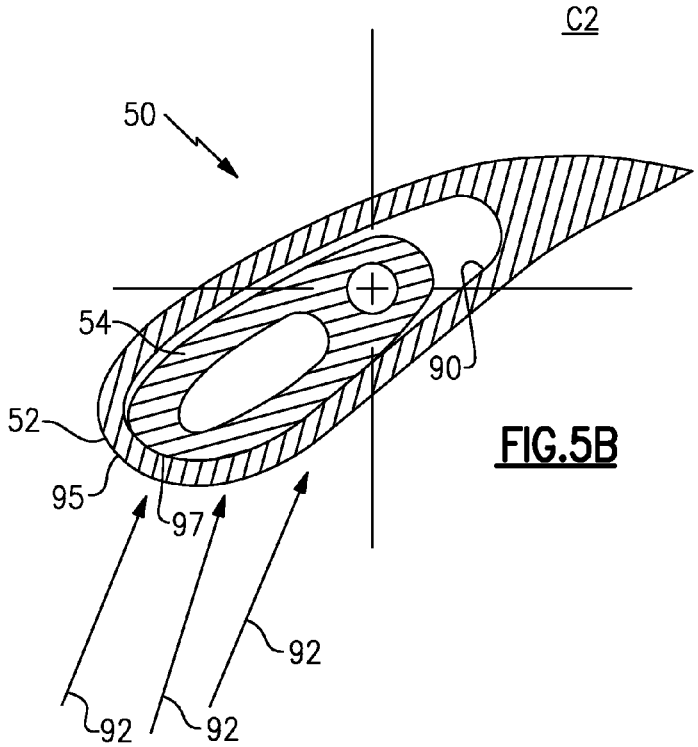
Figure 6:
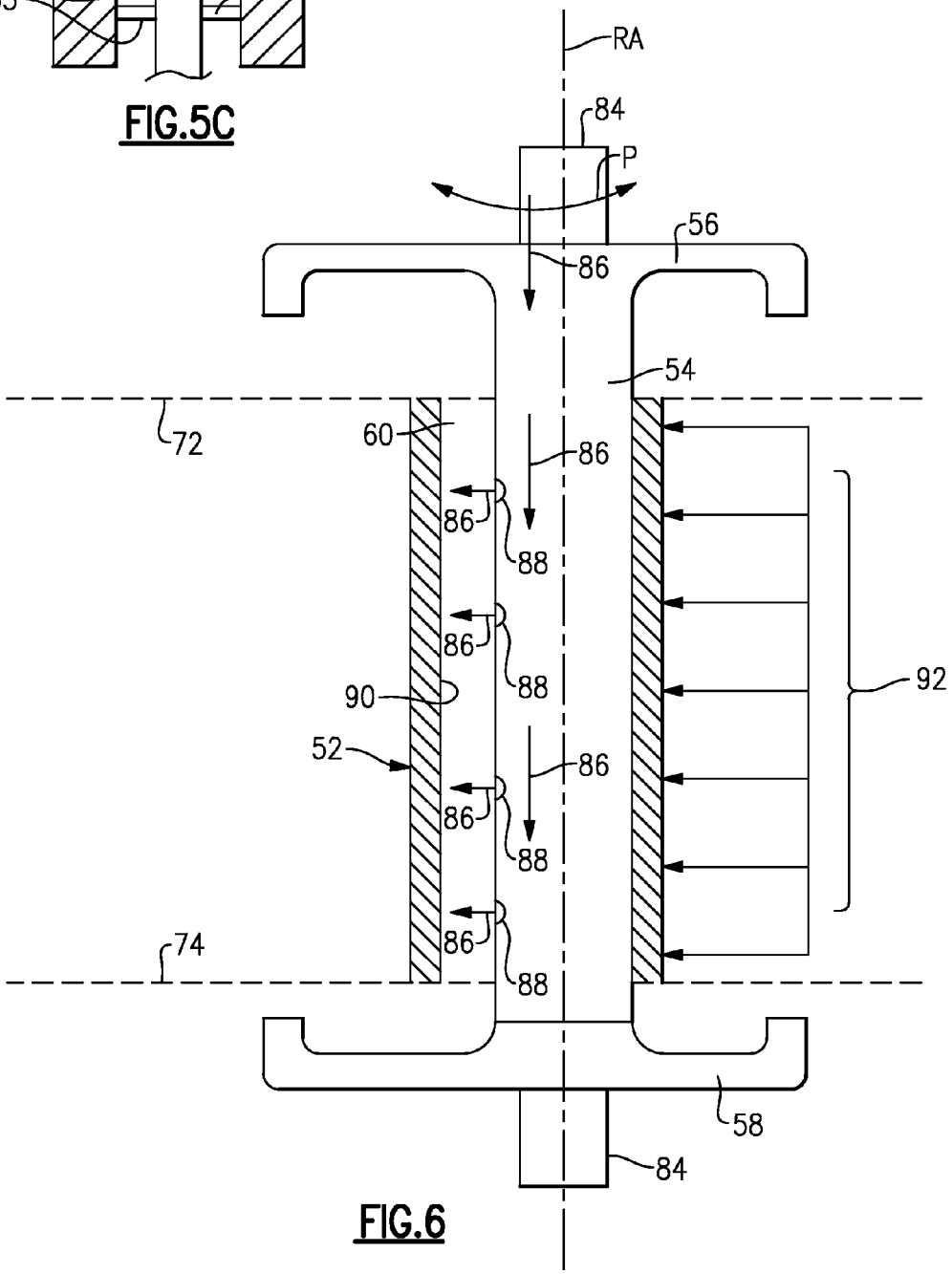
FIG. 6 illustrates additional features of a variable area component.

FIGS. 5A, 5B, and 6 schematically illustrate moving the spar 54 to effectuate a change in a rotational positioning of the shell 52 of the component 50. Changing the rotational positioning of the shell 52 changes a flow area associated with the component 50.

FIG. 5A illustrates a relationship between the shell 52 and the spar 54 during an assembled configuration C1 (i.e., prior to operation of the gas turbine engine). The spar 54 is moveable inside of the shell 52 and may or may not be in contact with an inner wall 90 of the shell 52.

The component 50 is illustrated during a second configuration C2 which occurs during gas turbine engine operation in FIG. 5B. During such operation, the shell 52 is pushed onto (i.e., into contact with) the spar 54. A gas load 92 may push the shell 52 onto the spar 54. In one embodiment, the gas load 92 is communicated against a leading edge 95 of the shell 52 to push the shell 52 against at least a leading edge 97 of the spar 54. Of course, the shell 52 and the spar 54 may engage one another in many other manners, such as differential thermal growth, and at other locations. Once the shell 52 is sufficiently engaged relative to the spar 54, the spar 54 may be pivoted to change the rotational positioning of the shell 52.

Figure 5C:
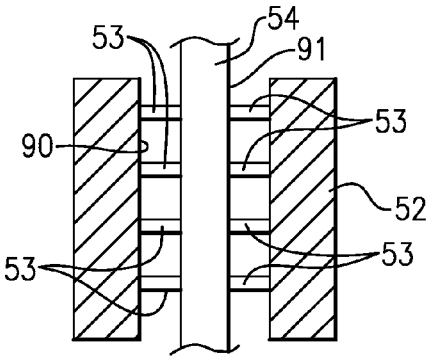
FIG. 5C illustrates a feature of a variable area component.

In one embodiment, illustrated in FIG. 5C, a plurality of stand-offs 53 may extend between the spar 54 and the shell 52 to maintain impingement distances between the spar 54 and the shell 52. For example, the stand-offs 53 may protrude from the spar 54 or the shell 52 to maintain a spacing between an outer wall 91 of the spar 54 and an inner wall 90 of the shell 52. Alternatively, the stand-offs 53 may be separate components that are attached to the shell 52 and the spar 54. Maintaining the spacing between the shell 52 and spar 54 ensures proper impingement of the cooling fluid 86 through the cooling openings 88 and onto the inner walls 90 (see FIG. 6). The stand-offs 53 may also aid in changing the positioning of the shell 52. The size, shape, placement and overall configuration of the stand-offs 53 can vary. In other words, the configuration shown in FIG. 5C is not intended to be limiting.

FIG. 6 schematically illustrates changing the positioning, such as the rotational positioning, of the shell 52. The first flange 56 and the second flange 58 are pivoted in a direction P (either clockwise or counterclockwise) to move the flanges 56, 58 about the rotational axis RA. Because the shell 52 has been moved (i.e., pushed or sucked) onto the spar 54 via the gas load 92, pivoting the spar 54 changes the rotational positioning of the shell 52 relative to the gas flow paths 72, 74 defined by the first platform 66 and the second platform 68. The spar 54 can rotate the shell 52 without the shell 52 interfering with the first platform 66 or the second platform 68 (platforms are removed in FIG. 6).

FIG. 6 additionally illustrates communication of the cooling fluid 86 through the cooling openings 88 of the spar 54 and into interior 60 to cool the inner walls 90 of the shell 52. The component 50 may or may not be cooled with such a dedicated cooling fluid.

Figure 7:
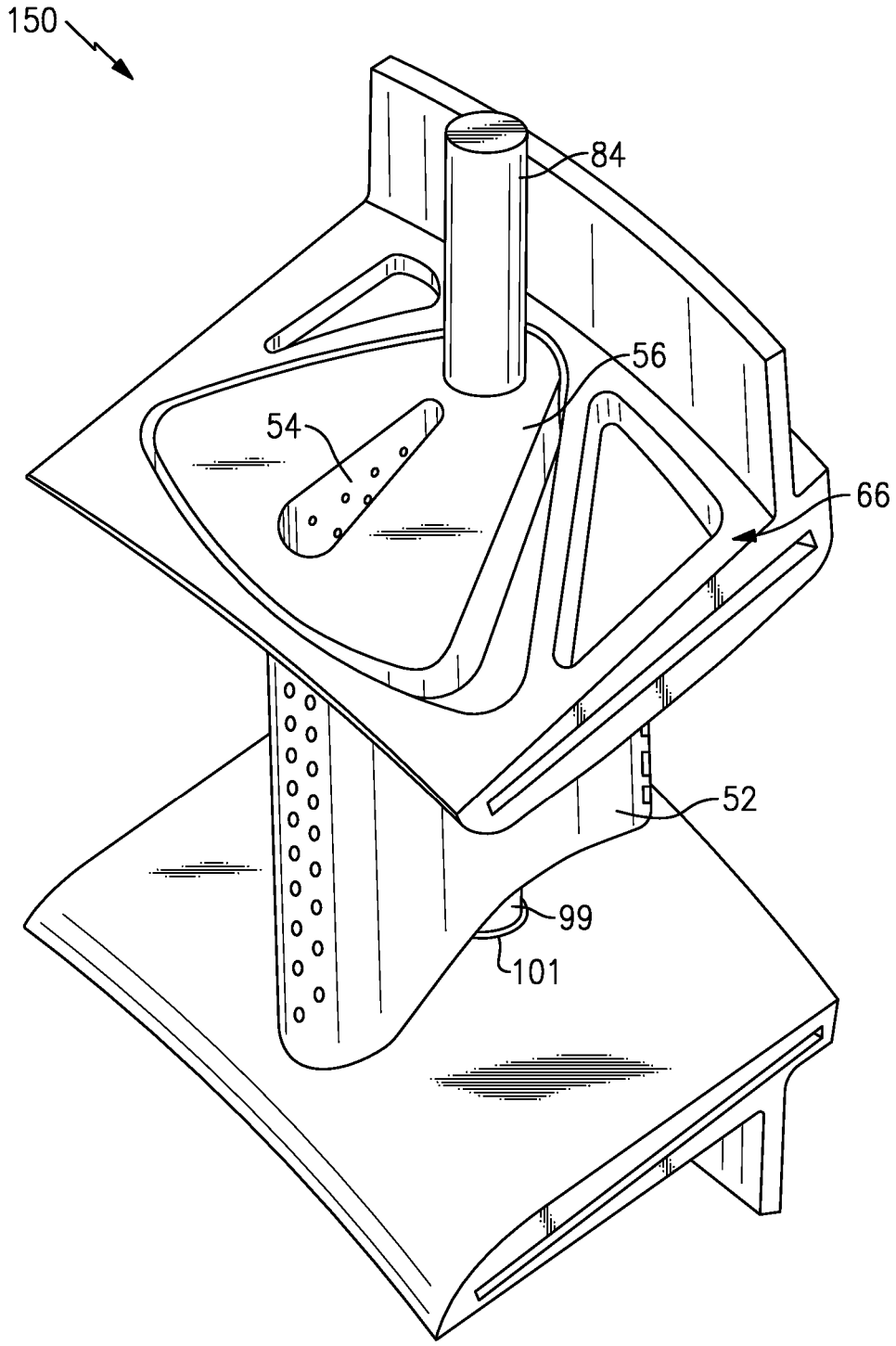
FIG. 7 illustrates another embodiment of a variable area component.
Figure 8:
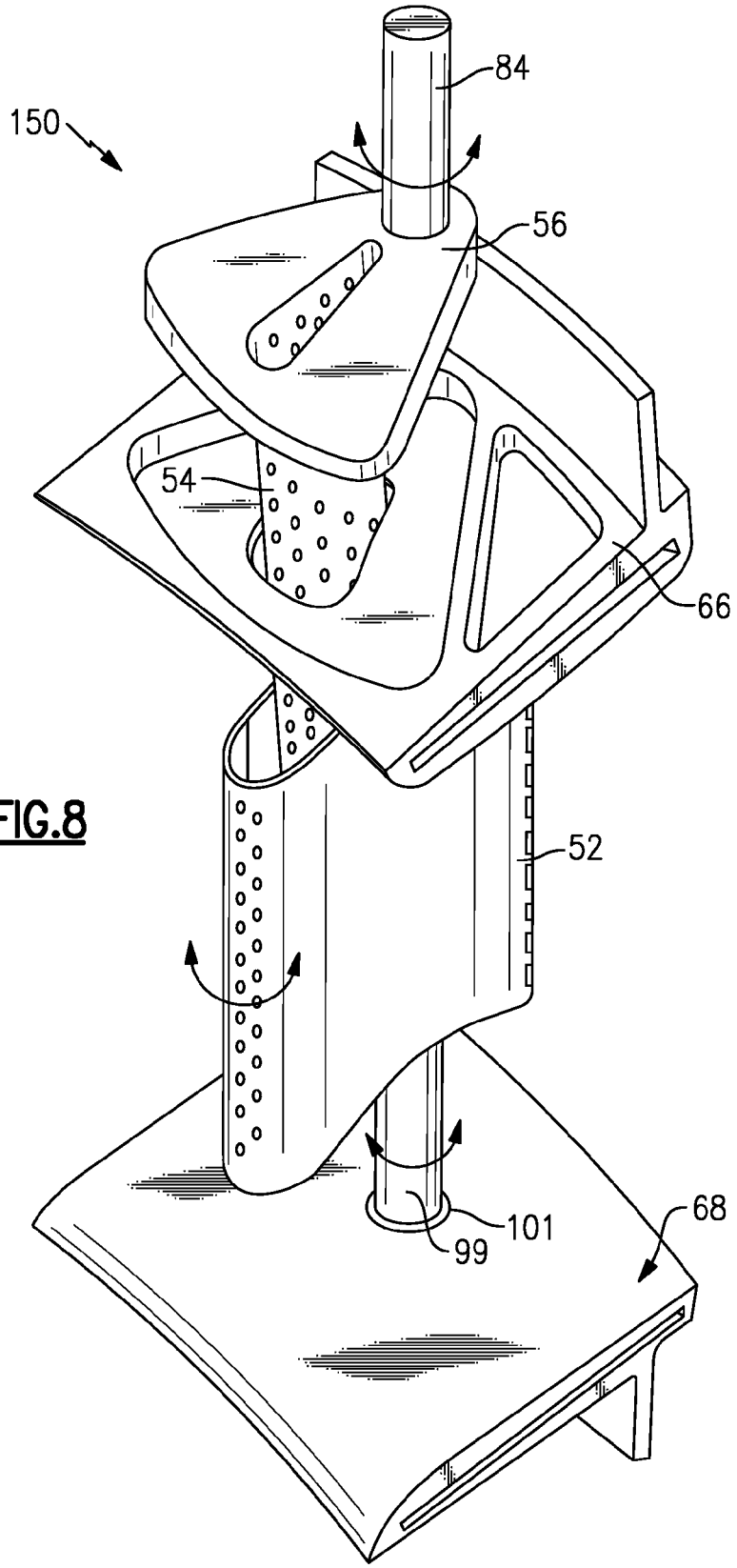
FIG. 8 illustrates an exploded view of FIG. 7.
Figure 9:
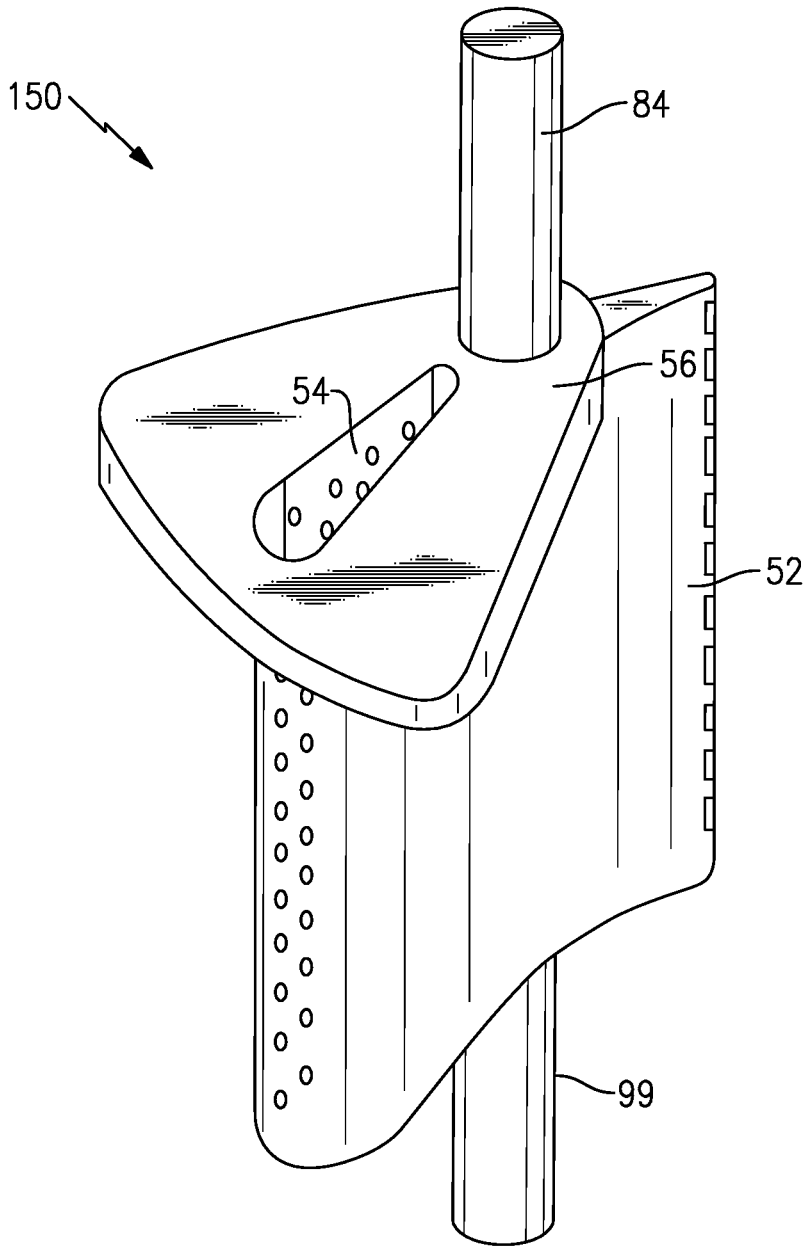
FIG. 9 illustrates portions of the component of FIG. 7.

FIGS. 7, 8 and 9 illustrate another exemplary embodiment of a component 150 that can be incorporated for use in a gas turbine engine. In this disclosure, like reference numerals designate like elements where appropriate and reference numerals with the addition of 100 or multiples thereof designate modified elements that are understood to incorporate the same features and benefits of the corresponding original elements. For ease of reference, the platforms 66, 68 have been removed from FIG. 9.

In this embodiment, the component 150 excludes the second flange (see second flange 58 of FIGS. 2-6). The first flange 56, the first platform 66, the shell 52 and the spar 54 are substantially similar to the embodiment of FIGS. 2-6. However, a second shaft 99 may extend from the spar 54 at an opposite end from the shaft 84. The second shaft 99 is received through an opening 101 of the second platform 68 (see FIGS. 7 and 8). The spar 54 may pivot about the shafts 84, 99 to change a rotational positioning of the shell 52.

Figure 10B:
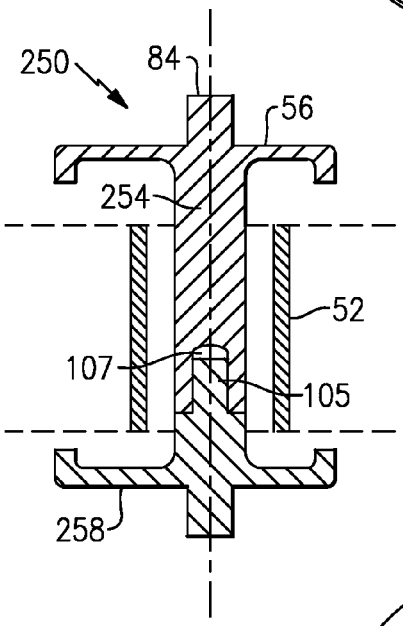
FIGS. 10A and 10B illustrate yet another exemplary variable area component.
Figure 10A:
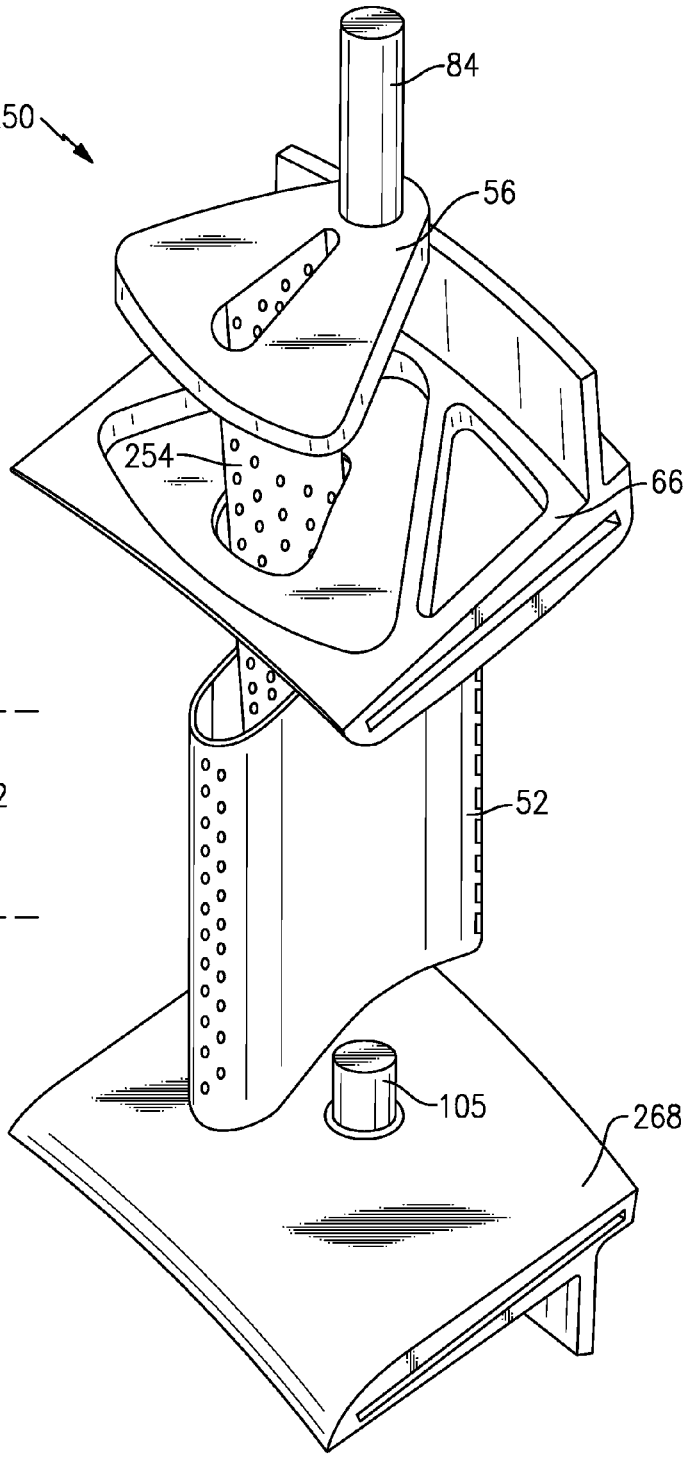

FIGS. 10A and 10B illustrate yet another embodiment of a component 250 that can be incorporated into a gas turbine engine. For ease of reference, the platforms have been removed from FIG. 10B.

The first flange 56, the first platform 66, and the shell 52 are substantially similar to the embodiment of FIGS. 2-6. However, in this embodiment, the component 250 includes a second flange 258 received relative to a second platform 268. The second flange 258 includes a post 105 that may extend through the second platform 268 and into a recess 107 defined by the spar 254. The spar 254 may pivot via the shaft 84 and the post 105 to change a rotational positioning of the shell 52.

An opposite configuration is also contemplated in which the second flange 258 includes the recess 107 and the spar 254 includes the post 105 received within the recess 107. The post 105 may embody any shape, including but not limited to round, hexagonal, square or rectangular.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component, comprising:
- a first platform;
- a shell extending from said first platform and defining an interior;
- a spar extending into said interior;
- a first flange attached to said spar and received within a triangle-shaped pocket formed in said first platform; and
- said spar configured to pivot to change a positioning of said shell.

2. The component as recited in claim 1, wherein said spar is comprised of a first material and said shell is comprised of a second material that is different from said first material.

3. The component as recited in claim 2, wherein said first material is a metal and said second material is a ceramic matrix composite.

4. The component as recited in claim 1, comprising a shaft that extends from said first flange in a direction opposite from said spar.

5. The component as recited in claim 1, wherein said shell is an airfoil sheath.

6. The component as recited in claim 1, wherein said first flange extends outside of said shell.

7. The component as recited in claim 1, comprising a second platform on an opposite side of said shell from said first platform.

8. The component as recited in claim 1, wherein said spar includes a plurality of cooling openings.

9. The component as recited in claim 1, wherein said spar is moveable within said interior.

10. The component as recited in claim 1, wherein said spar is connected to a second flange opposite from said first flange.

11. The component as recited in claim 1, comprising a plurality of stand-offs that extend between said spar and said shell, wherein said plurality of stand-offs protrude from one of said spar and said shell and extend toward the other of said spar and said shell.

12. A vane assembly, comprising:
- a first platform;
- a second platform;
- a variable vane that that extends between said first platform and said second platform, wherein said variable vane includes:
  - an airfoil sheath comprised of a first material;
  - a spar extending inside of said airfoil sheath and comprised of a second material;
  - a first flange attached to said spar and received within a triangle-shaped pocket formed in said first platform.

13. The assembly as recited in claim 12, wherein said first material is a metal and said second material is a ceramic matrix composite.

14. The assembly as recited in claim 12, wherein said variable vane is part of a turbine vane assembly.

15. The component recited in claim 1, wherein said first flange is triangle-shaped.

16. The component as recited in claim 15, wherein said first platform includes a hole for inserting said spar into said interior of said shell, and said first flange substantially covers said hole when received in said pocket, and said first flange includes an opening for communicating fluid into a hollow portion of said spar.

17. A component, comprising:
- a first platform;
- a shell extending from said first platform and defining an interior;
- a spar extending into said interior;
- a first flange attached to said spar and received within a pocket formed in said first platform, the pocket having a first surface and a second surface, wherein the flange is pivotable between a first position abutting the first surface and a second position abutting the second surface; and
- said spar configured to pivot to change a positioning of said shell.

18. The component as recited in claim 17, wherein said flange is triangle-shaped, and said pocket is triangle-shaped.

19. The component as recited in claim 17, comprising a plurality of stand-offs that extend between said spar and said shell, wherein said plurality of stand-offs protrude from one of said spar and said shell and extend toward the other of said spar and said shell, and wherein said spar is comprised of metal and said shell is comprised of a ceramic matrix composite, and said spar includes a plurality of cooling openings.

20. The vane assembly as recited in claim 12, wherein said spar is connected to a second flange opposite from said first flange, said second flange includes a sealing surface for sealing relative to said second platform, a first shaft extends from the first flange in a first direction opposite from said spar, a second shaft extends from the second flange in a second direction opposite from said spar, and a rotational axis extends through the first shaft and the second shaft through which rotation moves said spar.

* * * * *